US008771102B2

(12) United States Patent
Beach et al.

(10) Patent No.: US 8,771,102 B2
(45) **Date of Patent: *Jul. 8, 2014**

(54) GOLF CLUB HEAD

(71) Applicant: Taylor Made Golf Company, Inc., Carlsbad, CA (US)

(72) Inventors: Todd P. Beach, Encinitas, CA (US); Peter L. Larsen, San Marcos, CA (US); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/917,512

(22) Filed: Jun. 13, 2013

(65) Prior Publication Data

US 2013/0274031 A1 Oct. 17, 2013

Related U.S. Application Data

(63) Continuation of application No. 12/689,973, filed on Jan. 19, 2010, now Pat. No. 8,475,295, which is a continuation of application No. 11/879,038, filed on Jul. 12, 2007, now Pat. No. 7,674,189, which is a continuation-in-part of application No. 11/787,103, filed on Apr. 12, 2007, now abandoned.

(51) Int. Cl.
*A63B 53/04* (2006.01)

(52) U.S. Cl.
USPC ..... 473/345

(58) Field of Classification Search
USPC ..... 473/324–350
See application file for complete search history.

(56) References Cited

U.S. PATENT DOCUMENTS

| | | | |
|---|---|---|---|
| 3,486,755 | A | 12/1969 | Hodge |
| 4,712,798 | A | 12/1987 | Preato |
| 5,346,217 | A | 9/1994 | Tsuchiya et al. |
| 5,354,055 | A | 10/1994 | MacKeil |
| 5,366,222 | A | 11/1994 | Lee |
| 5,425,538 | A | 6/1995 | Vincent et al. |

(Continued)

FOREIGN PATENT DOCUMENTS

| | | |
|---|---|---|
| JP | 01-256981 | 10/1989 |
| JP | 04-256764 | 9/1992 |

(Continued)

OTHER PUBLICATIONS

Taylor Made Golf Company Inc., *R7 460 Drivers*, downloaded from www.taylormadegolf.com/product_detail.asp?pID=14section=overview on Apr. 5, 2007.

(Continued)

*Primary Examiner* — Alvin Hunter
(74) *Attorney, Agent, or Firm* — Klarquist Sparkman, LLP

(57) ABSTRACT

A high forgiveness wood-type golf club head comprises a body and a face. The body defines an interior cavity and comprises a sole that forms a bottom portion of the golf club head, a crown that forms a top portion of the golf club head and a skirt that forms a periphery of the golf club head between the sole and the crown. The face place is positioned at a front portion of the golf club head opposite a rear portion of the golf club head. The body defines an outer periphery having a generally triangular shape in plan.

20 Claims, 7 Drawing Sheets

(56) References Cited

U.S. PATENT DOCUMENTS

| | | | | |
|---|---|---|---|---|
| D365,615 | S | 12/1995 | Shimatani | |
| 5,620,379 | A | 4/1997 | Borys | |
| 5,746,666 | A | 5/1998 | Lovett | |
| 5,935,020 | A | 8/1999 | Stites et al. | |
| 6,048,278 | A | 4/2000 | Meyer et al. | |
| 6,074,310 | A | 6/2000 | Ota | |
| 6,139,446 | A | 10/2000 | Wanchena | |
| RE36,950 | E | 11/2000 | Allen | |
| 6,152,833 | A | 11/2000 | Werner et al. | |
| 6,244,974 | B1 | 6/2001 | Hanberry, Jr. | |
| 6,254,494 | B1 | 7/2001 | Hasebe et al. | |
| 6,340,337 | B2 | 1/2002 | Hasebe et al. | |
| 6,354,962 | B1 | 3/2002 | Galloway et al. | |
| 6,390,933 | B1 | 5/2002 | Galloway et al. | |
| 6,425,832 | B2 | 7/2002 | Cackett et al. | |
| 6,435,982 | B1 | 8/2002 | Galloway et al. | |
| 6,471,604 | B2 | 10/2002 | Hocknell et al. | |
| 6,491,592 | B2 | 12/2002 | Cackett et al. | |
| 6,494,790 | B1 | 12/2002 | Toyota et al. | |
| 6,524,194 | B2 | 2/2003 | McCabe | |
| 6,572,489 | B2 | 6/2003 | Miyamoto et al. | |
| 6,572,491 | B2 | 6/2003 | Hasebe et al. | |
| 6,607,452 | B2 | 8/2003 | Helmstetter et al. | |
| 6,679,782 | B2 | 1/2004 | Tang et al. | |
| 6,679,786 | B2 | 1/2004 | McCabe | |
| 6,716,110 | B1 | 4/2004 | Ballow | |
| 6,716,114 | B2 | 4/2004 | Nishio | |
| 6,783,466 | B2 | 8/2004 | Seki et al. | |
| 6,875,130 | B2 | 4/2005 | Nishio | |
| 6,913,546 | B2 | 7/2005 | Kakiuchi | |
| 7,166,038 | B2 | 1/2007 | Williams et al. | |
| 7,431,667 | B2 | 10/2008 | Vincent et al. | |
| 7,497,789 | B2 | 3/2009 | Burnett et al. | |
| 7,674,189 | B2 * | 3/2010 | Beach et al. | 473/345 |
| 8,475,295 | B2 * | 7/2013 | Beach et al. | 473/345 |
| 2002/0091015 | A1 | 7/2002 | Seki et al. | |
| 2008/0102978 | A1 | 5/2008 | Burnett et al. | |
| 2008/0254911 | A1 | 10/2008 | Beach et al. | |

FOREIGN PATENT DOCUMENTS

| | | |
|---|---|---|
| JP | 08-155063 | 6/1996 |
| JP | 08-257175 | 10/1996 |
| JP | 11-178955 | 7/1999 |
| JP | 11-253586 | 9/1999 |
| JP | 11-290489 | 10/1999 |
| JP | 11-347158 | 12/1999 |
| JP | 2000-167089 | 6/2000 |
| JP | 2000-262656 | 9/2000 |
| JP | 2000-300701 | 10/2000 |
| JP | 2001-095955 | 4/2001 |
| JP | 2001-161865 | 6/2001 |
| JP | 2001-252378 | 9/2001 |
| JP | 2002-065907 | 3/2002 |
| JP | 2002-248182 | 9/2002 |
| JP | 2002-301174 | 10/2002 |
| JP | 2003-210620 | 7/2003 |
| JP | 2003-310806 | 11/2003 |
| JP | 2004-261451 | 9/2004 |
| JP | 2005-052458 | 3/2005 |
| JP | 2005-137788 | 6/2005 |

OTHER PUBLICATIONS

Nike Golf, *Sasquatch 460*, downloaded from www.nike.com/nikegolf/index.htm on Apr. 5, 2007.

Callaway Golf, *World's Straightest Driver: FT-i Driver* downloaded from www.callawaygolf.com/ft%2Di/driver.aspx?lang=en on Apr. 5, 2007.

Nike Golf, *Sasquatch Sumo Squared Driver*, downloaded from www.nike.com/nikegolf/index.htm on Apr. 5, 2007.

*Titleist 907D1*, downloaded from www.tees2greens.com/forum/Uploads/Images/7ade3521-192b-4611-870b-395d.jpg on Feb. 1, 2007.

Jeff Jackson, The Modern Guide to Golf Clubmaking; Ohio: Dynacraft Golf Products, Inc., copyright 1994, p. 237.

Office Action dated Oct. 31, 2008, issued in corresponding U.S. Appl. No. 11/879,038, filed Jul. 12, 2007.

Office Action dated Dec. 17, 2008, issued in corresponding U.S. Appl. No. 11/879,038, filed Jul. 12, 2007.

Office Action dated Apr. 15, 2009, issued in corresponding U.S. Appl. No. 11/879,038, filed Jul. 12, 2007.

Office Action dated Feb. 15, 2008, issued in U.S. Appl. No. 11/552,729, filed Oct. 25, 2006.

* cited by examiner

GOLF CLUB HEAD

CROSS REFERENCE TO RELATED APPLICATIONS

The present application is a continuation of U.S. patent application Ser. No. 12/689,973, filed Jan. 19, 2010, which is a continuation of U.S. patent application Ser. No. 11/879,038, filed Jul. 12, 2007, which is a continuation-in-part of U.S. patent application Ser. No. 11/787,103, filed Apr. 12, 2007. These applications are incorporated herein by this reference.

FIELD

The present application relates to a golf club head, and more particularly, to a golf club head having high moments of inertia.

BACKGROUND

Golf club head manufacturers and designers are constantly looking for ways to improve golf club head performance, which includes the forgiveness and playability of the golf club head, while having an aesthetic appearance. Generally, "forgiveness" can be defined as the ability of a golf club head to compensate for mishits, i.e., hits resulting from striking the golf ball at a less than an ideal impact location on the golf club head. Similarly, "playability" can be defined generally as the ease in which a golfer having any of various skill levels can use the golf club head for producing quality golf shots.

Golf club head performance can be directly affected by the moments of inertia of the club head. A moment of inertia is the measure of a club head's resistance to twisting upon impact with a golf ball. Generally, the higher the moments of inertia of a golf club head, the less the golf club head twists at impact with a golf ball, particularly during "off-center" impacts with a golf ball. The less a golf club head twists, the greater the forgiveness of the golf club head and the greater the probability of hitting a straight golf shot. In some instances, a golf club head with high moments of inertia may also result in an increased ball speed upon impact with the golf club head, which generally translates into increased golf shot distance.

In general, the moment of inertia of a mass about a given axis is proportional to the square of the distance of the mass away from the axis. In other words, the greater the distance of a mass away from a given axis, the greater the moment of inertia of the mass about the given axis. Accordingly, golf club head designers and manufacturers have sought to increase the moment of inertia about one or more golf club head axes, which are typically axes extending through the golf club head center of gravity, by increasing the distance of the head mass away from the axes of interest.

United States Golf Association (USGA) regulations and constraints on golf club head shapes, sizes and other characteristics tend to limit the moments of inertia achievable by a golf club head. According to the most recent version of the USGA regulations, golf club heads must, inter alia, be generally plain in shape, have a reasonable and traditional head mass between 203 and 213 grams, have envelope dimensions at or below maximum envelope dimensions (maximum height of 2.8 inches, maximum width of 5.0 inches and a maximum depth of 5.0 inches), and have a volume at or below a maximum head volume of 460 $cm^3$. It should be noted that this maximum volume constraint of 460 $cm^3$ is well below the volume of the maximum envelope dimensions.

Often, golf club manufacturers are faced with the choice of increasing one performance characteristic at the expense of another. For example, the shape and size of some conventional golf club heads approach the maximum envelope dimensions in an attempt to increase the moments of inertia of the heads. Such designs, however, most likely require a decrease in the face size, or ball striking surface area, in order to comply with the USGA regulations. As another example, some conventional golf club heads have an increased face size in an attempt to optimize the ball striking surface of the golf club head. Such golf club head designs, however, typically have decreased moments of inertia.

Golf club designers and manufacturers have struggled to design golf club heads having increased moments of inertia while maintaining other desirable golf club head characteristics and abiding by the USGA regulations.

SUMMARY

Described below are embodiments of a golf club head having high moments of inertia and/or a generally triangular shape in plan.

According to some embodiments, a golf club head comprises a body defining an interior cavity and comprising a sole positioned at a bottom portion of the golf club head, a crown positioned at a top portion and a skirt positioned around a periphery between the sole and the crown. The body has a forward portion and a rearward portion. A face having an ideal impact location, e.g., the geometric center of the face, is positioned at the forward portion of the body. The body extends a distance L transversely away from a face plane defined herein as a plane extending tangential to the ideal impact location on the face. The body defines cross-sectional areas A along planes parallel to the face plane and spaced rearward from the face plane by a distance q. A body region is defined between a dimension of q/L of about 0.05 to a dimension of q/L of about 1.0. Within the body region, at least about 50% of the cross-sectional areas A are between an upper cross-sectional area limit $A_u$ and a lower cross-sectional area limit $A_l$ where (1) $A_u=5512(q/L)^2-14026(q/L)+8875+1200(q/L)+500$, and (2) $A_l=5512(q/L)^2-14026(q/L)+8875-2000[1-(q/L)]^2-300$.

In some embodiments, at least about 60% of the cross-sectional areas A within the body region are between the upper cross-sectional area limit $A_u$ and the lower cross-sectional area limit A. In other embodiments, at least about 70% of the cross-sectional areas A within the body region are between $A_u$ and $A_l$. In still other embodiments, at least about 80% of the cross-sectional areas A within the body region are between $A_u$ and $A_l$.

In some embodiments, the golf club head has a moment of inertia about a head center of gravity x-axis of at least approximately 300 $kg \cdot mm^2$ and a moment of inertia about a head center of gravity z-axis of at least approximately 450 $kg \cdot mm^2$. In some embodiments, the golf club head has a volume between approximately 350 $cm^3$ and approximately 500 $cm^3$.

In some embodiments, the distance L is between approximately 100 mm and approximately 170 mm. The golf club head can have a width between approximately 100 mm and approximately 170 mm. The golf club head can have a height between approximately 60 mm and approximately 85 mm.

A head origin can be defined for the golf club head as a position on the face plane at a geometric center of the face. The head origin can include an x-axis tangential to the face and generally parallel to the ground when the head is ideally positioned (i.e., at a proper address position), with a positive x-axis extending toward the heel portion, a y-axis extending perpendicular to the x-axis and generally parallel to the ground when the head is ideally positioned with a positive y-axis extending from the face and through the rearward portion of the body, and a z-axis extending perpendicular to the ground, to the x-axis and to the y-axis when the head is ideally positioned with a positive z-axis extending from the origin and generally upward.

The golf club head can have a center of gravity with an x-axis coordinate between approximately −5 mm and approximately 10 mm, a y-axis coordinate between approximately 20 mm and approximately 50 mm, and a z-axis coordinate between approximately −10 mm and approximately 5 mm. In some specific implementations, the x-axis coordinate is between approximately −2 mm and approximately 7 mm, the y-axis coordinate is between approximately 30 mm and approximately 40 mm, and the z-axis coordinate is between approximately −7 mm and approximately 2 mm.

In some implementations, the face comprises a face plate made from a composite material.

According to some embodiments, a golf club head comprises a body defining an interior cavity and comprising a sole that forms a bottom portion of the golf club head, a crown that forms at a top portion of the golf club head, and a skirt that forms a periphery of the golf club head from a toe portion to a heel portion and between the sole and the ground. The body can have a forward portion and a rearward portion. A face can be positioned at the forward portion of the body and have a ball striking surface area between about 7,900 $mm^2$ and about 9,000 $mm^2$. The body can extend a distance L transversely away from a face plane extending tangential to an ideal impact location on the face. The golf club head can have a volume between about 350 $cm^3$ and about 500 $cm^3$ and a center of gravity within the body. The golf club head can have a moment of inertia about a first axis passing through the center of gravity of at least approximately 300 $kg \cdot mm^2$ and a moment of inertia about a second axis passing through the center of gravity and perpendicular to the first axis of at least approximately 450 $kg \cdot mm^2$. The body can comprise a first outermost peripheral edge extending from the heel portion to the rearward portion and a second outermost peripheral edge extending from the toe portion to the rearward portion. The first outermost peripheral edge forms an angle with the second outermost peripheral edge between approximately 45° and approximately 75° within a body region defined approximately between q/L of about 0.10 and q/L of about 0.9 where q is a distance away from the face plane in a direction generally perpendicular to the face plane.

The first and second peripheral edges within the body region can be substantially linear. Alternatively, the first and second peripheral edges within the body region can be curved. The periphery of the golf club head when viewed from above can define a generally triangular or trianguloid shape.

According to some embodiments, a golf club head comprises a body defining an interior cavity and comprising a sole positioned at a bottom portion of the golf club head, a crown positioned at a top portion, and a skirt positioned about a periphery between the sole and the crown, wherein the body has a forward portion and a rearward portion. A face can be positioned at the forward portion of the body. The body can extend a distance L transversely away from a face plane extending tangential to an ideal impact location on the face. The golf club head can have a volume between about 350 $cm^3$ and about 500 $cm^3$. The body can define cross-sectional areas along planes parallel to the face plane and spaced rearward from the face by a distance q. The cross-sectional areas between a dimension q/L of about 0.10 and a dimension q/L of about 0.90 decrease from the forward portion to the rearward portion. The decrease in cross-sectional areas within a first body region defined approximately between q/L of about 0.10 and q/L of about 0.50 is between approximately 45% and approximately 70%, and the decrease in cross-sectional areas within a second body region defined between q/L of about 0.50 and q/L of about 0.90 is between approximately 65% and approximately 95%. In specific implementations, the decrease in cross-sectional areas with the first body region is less than approximately 60% and the decrease in cross-sectional areas within the second body region is less than approximately 80%.

According to some embodiments, a high forgiveness wood-type golf club head comprises a body and a face positioned at a front portion of the body. The body defines an interior cavity and comprises a sole positioned at a lower portion, a crown positioned at an upper portion, and a skirt positioned around a periphery between the sole and the crown. The body defines an outer periphery having a general triangular shape in plan.

In some embodiments, a method of designing a high forgiveness golf club head comprises determining a desired area and shape of a ball striking surface of the golf club head, determining a desired overall depth of the golf club head from the ball striking surface to a rear surface of the golf club head, determining a desired volumetric displacement of the golf club head, and shaping a portion of the golf club head between the ball striking surface and the rear surface such that the golf club head is generally triangular in plan and has the ball striking area of the desired area and shape, the desired overall depth and the desired volumetric displacement.

The foregoing and other features and advantages of the golf club head will become more apparent from the following detailed description, which proceeds with reference to the accompanying drawings.

DETAILED DESCRIPTION

Figure 1:
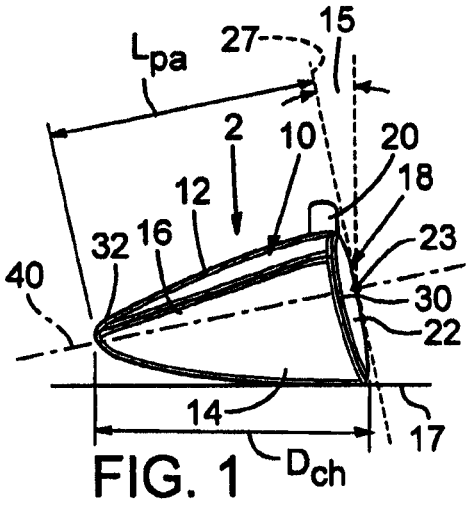
FIG. 1 is an elevational side view of a golf club head according to a first embodiment.

Embodiments of a golf club head providing desired center-of-gravity (CG) properties and increased moments of inertia are described herein. In some embodiments, the golf club head has an optimal shape for providing maximum golf shot forgiveness given a maximum head volume, a maximum head face area, and a maximum head depth according to desired values of these parameters, and allowing for other considerations, e.g., the physical attachment of the golf club head to a golf club shaft and aesthetics. Golf shot forgiveness is generally maximized by configuring the golf club head such that the CG of the golf club head is optimally located and the moments of inertia of the golf club head are maximized.

In other embodiments, the golf club head has a shape with dimensions at or near at least some of the golf club head dimensional constraints set by current USGA regulations. In such embodiments, the golf club head falls within a predetermined golf head shape range that results in more favorable CG locations and increased moments of inertia, and thus more golf shot forgiveness, than conventional golf club heads.

In the following description, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. These terms are not, however, intended to imply absolute relationships, positions, and/or orientations. For example, with respect to an object, an "upper" surface can become a "lower" surface simply by turning the object over. Nevertheless, it is still the same object.

As illustrated in FIGS. 1-7, a wood-type (e.g., driver or fairway wood) golf club head, such as golf club head 2, includes a hollow body 10 having a crown 12, a sole 14, a skirt 16, a striking face, or face portion, 18, and a hosel 20, which defines a hosel bore 24 adapted to receive a golf club shaft (not shown). The body 10 further includes a heel portion 26, a toe portion 28, a front portion 30, and a rear portion 32. The club head 2 also has a volume, typically measured in cubic-centimeters ($cm^3$), equal to the volumetric displacement of the club head 2.

Figure 3:
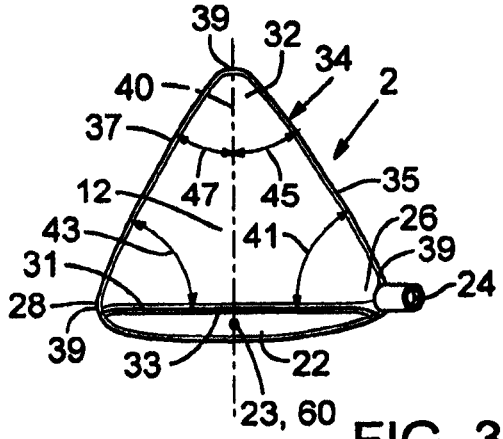
FIG. 3 is a top view of the golf club head of FIG. 1.

The crown 12 is defined as an upper portion of the club head (1) above a peripheral outline 34 of the club head as viewed from a top-down direction; and (2) rearwards of the topmost portion of a ball striking surface 22 of the striking face 18 (see FIG. 3). The striking surface 22 is defined as a front or external surface of the striking face 18 and is adapted for impacting a golf ball (not shown). In several embodiments, the striking face or face portion 18 can be a striking plate attached to the body 10 using conventional attachment techniques, such as welding, as will be described in more detail below. In some embodiments, the striking surface 22 can have a bulge and roll curvature.

The sole 14 is defined as a lower portion of the club head 2 extending upwards from a lowest point of the club head when the club head is ideally positioned, i.e., at a proper address position relative to a golf ball on a level surface. In some implementations, the sole 14 extends approximately 50% to 60% of the distance from the lowest point of the club head to the crown 12, which in some instances, can be approximately 15 mm for a driver and between approximately 10 mm and 12 mm for a fairway wood.

A golf club head, such as the club head 2, is at its proper address position when angle 15 is approximately equal to the golf club head loft and when the golf club head lie angle 19 is approximately equal to 60 degrees. Angle 15 is the angle defined between a face plane 27, defined as the plane tangent to an ideal impact location 23 on the striking surface 22, and a vertical plane relative to the ground 17. Angle 19 is the angle defined between a longitudinal axis 21 of the hosel 20 or shaft and the ground 17. The ground, as used herein, is assumed to be a level plane.

In the illustrated embodiment, the ideal impact location 23 of the golf club head (see FIGS. 1, 6 and 7) is disposed at the geometric center of the striking surface 22, which is typically defined as the intersection of the midpoints of a height ($H_{ss}$) and width ($W_{ss}$) of the striking surface. See USGA "Procedure for Measuring the Flexibility of a Golf Clubhead," Revision 2.0.

The skirt 16 includes a side portion of the club head 2 between the crown 12 and the sole 14 that extends across a periphery 34 of the club head, excluding the striking surface 22, from the toe portion 28, around the rear portion 32, to the heel portion 26.

In some embodiments, the striking face 18 is made of a composite material such as described in U.S. Patent Application Publication Nos. 2005/0239575 and 2004/0235584, U.S. patent application Ser. No. 11/642,310, and U.S. Provisional Patent Application No. 60/877,336, which are incorporated herein by reference. In other embodiments, the striking face 18 is made from a metal alloy (e.g., titanium, steel, aluminum, and/or magnesium), ceramic material, or a combination of composite, metal alloy, and/or ceramic materials. Further, the striking face 18 can be a striking plate having a variable thickness such as described in U.S. Pat. No. 6,997,820, which is incorporated herein by reference.

The crown 12, sole 14, and skirt 16 can be integrally formed using techniques such as molding, cold forming, casting, and/or forging and the striking face 18 can be attached to the crown, sole and skirt by means known in the art. For example, the striking face 18 can be attached to the body 10 as described in U.S. Patent Application Publication Nos. 2005/0239575 and 2004/0235584. The body 10 can be made from a metal alloy (e.g., titanium, steel, aluminum, and/or magnesium), composite material, ceramic material, or any combination thereof. The body 10 can also have a thin-walled construction, such as described in U.S. application Ser. No. 11/067,475, filed Feb. 25, 2005, which is incorporated herein by reference.

Figure 5:
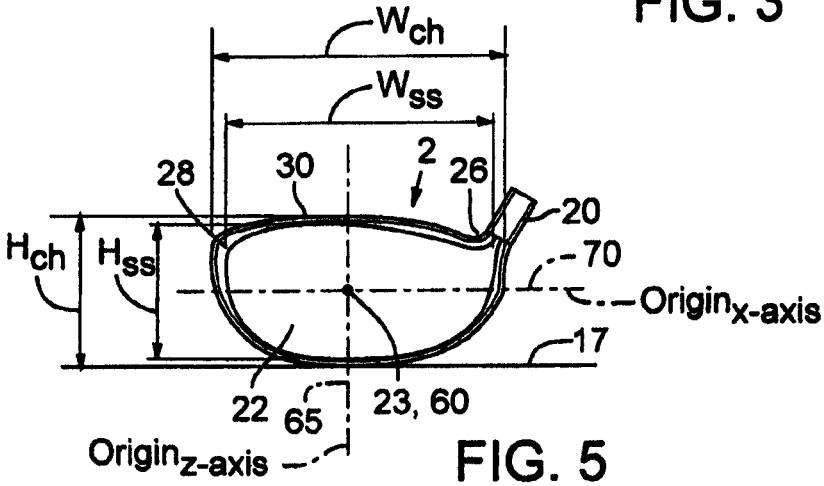
FIG. 5 is an elevational front view of the golf club head similar to FIG. 2, but showing particular width and height dimensions of the golf club head.
Figure 6:
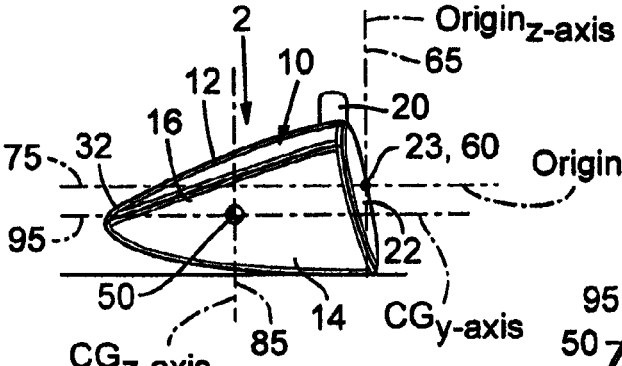
FIG. 6 is an elevational side view of the golf club head of FIG. 1 showing a golf club head origin coordinate system and a center-of-gravity coordinate system.
Figure 7:
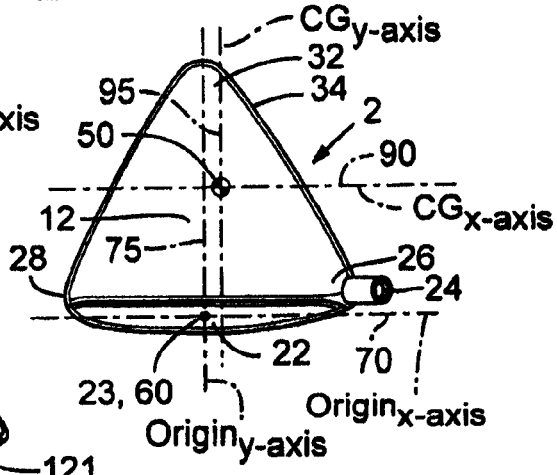
FIG. 7 is a top view of the golf club head of FIG. 1 showing the golf club head origin coordinate system and the center-of-gravity coordinate system.

A club head origin coordinate system may be provided such that the location of various features of the club head (including, e.g., a club head center-of-gravity (CG) 50) can be determined. Referring to FIGS. 5-7, a club head origin 60 is represented on club head 2. The club head origin 60 is positioned at the ideal impact location 23, or geometric center, of the striking surface 22.

The head origin coordinate system, as defined with respect to the head origin 60, includes three axes: a z-axis 65 extending through the head origin 60 in a generally vertical direction relative to the ground 17 when the club head 2 is at the address position; an x-axis 70 extending through the head origin 60 in a toe-to-heel direction generally parallel to the striking surface 22, i.e., generally tangential to the striking surface 22 at the ideal impact location 23, and generally perpendicular to the z-axis 65; and a y-axis 75 extending through the head origin 60 in a front-to-back direction and generally perpendicular to the x-axis 70 and to the z-axis 65. The x-axis 70 and the y-axis 75 both extend in generally horizontal directions relative to the ground 17 when the club head 2 is at the address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12.

In one embodiment, the golf club head can have a CG with an x-axis coordinate between approximately −5 mm and approximately 10 mm, a y-axis coordinate between approximately 20 mm and approximately 50 mm, and a z-axis coordinate between approximately −10 mm and approximately 5 mm. In some specific implementations, the CG x-axis coordinate is between approximately −2 mm and approximately 7 mm, the CG y-axis coordinate is between approximately 30 mm and approximately 40 mm, and the CG z-axis coordinate is between approximately −7 mm and approximately 2 mm.

Referring to FIGS. 1 and 5, the golf club heads described herein, such as club head 2, each have a maximum height ($H_{ch}$), width ($W_{ch}$) and depth ($D_{ch}$). As used herein, the maximum height ($H_{ch}$) is defined as the distance between the lowest and highest points on the outer surface of the golf club head body, such as body 10, measured along an axis parallel to the origin z-axis, such as z-axis 65, when the club head is at proper address position; the maximum width ($W_{ch}$) is defined as the distance between the maximum extents of the heel and toe portions, such as portions 26, 28, of the body measured along an axis parallel to the origin x-axis, such as x-axis 70, when the club head is at proper address position; and the maximum depth ($D_{ch}$) is defined as the distance between the forwardmost and rearwardmost points on the surface of the body measured along an axis parallel to the origin y-axis, such as y-axis 75 (see FIGS. 6 and 7), when the club head is at proper address position. As used herein, the height and width of a club head, such as club head 2, are measured according to the USGA "Procedure for Measuring the Clubhead Size of Wood Clubs" Revision 1.0; and Rules of Golf, Appendix II(4)(b)(i). Each golf club head described herein also includes a principal axis, such as principle axis 40 of golf club head 2, defined to extend normal to the head's face plane at the ideal impact location of the face plane; and a principal axis length ($L_{pa}$) defined as the distance between the forwardmost and rearwardmost points on the surface of the body of the golf club head measured along the principal axis of the head.

Referring to FIGS. 6 and 7, golf club head moments of inertia are typically defined about three axes extending through the golf club head CG 50: (1) a CG z-axis 85 extending through the CG 50 in a generally vertical direction relative to the ground 17 when the club head 2 is at address position; (2) a CG x-axis 90 extending through the CG 50 in a heel-to-toe direction generally parallel to the striking surface 22 and generally perpendicular to the CG z-axis 85; and (3) a CG y-axis 95 extending through the CG 50 in a front-to-back direction and generally perpendicular to the CG x-axis 90 and the CG z-axis 85. The CG x-axis 90 and the CG y-axis 95 both extend in a generally horizontal direction relative to the ground 17 when the club head 2 is at the address position.

A moment of inertia about the golf club head CG x-axis 90 is calculated by the following equation $$I_{CG_x}=\int(y^2+z^2)dm \tag{1}$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis 90 and the golf club head CG z-axis 85. The CG xy-plane is a plane defined by the golf club head CG x-axis 90 and the golf club head CG y-axis 95.

Similarly, a moment of inertia about the golf club head CG z-axis 85 is calculated by the following equation $$I_{CG_x}=\int(x^2+y^2)dm \tag{2}$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis 95 and the golf club head CG z-axis 85.

In certain implementations, club head 2 may have a moment of inertia about the CG z-axis $I_{CG_x}$ between about 450 kg·mm$^2$ and about 650 kg·mm$^2$; and a moment of inertia about the CG x-axis $I_{CG_x}$ between about 300 kg·mm$^2$ and about 500 kg·mm$^2$.

Figure 8:
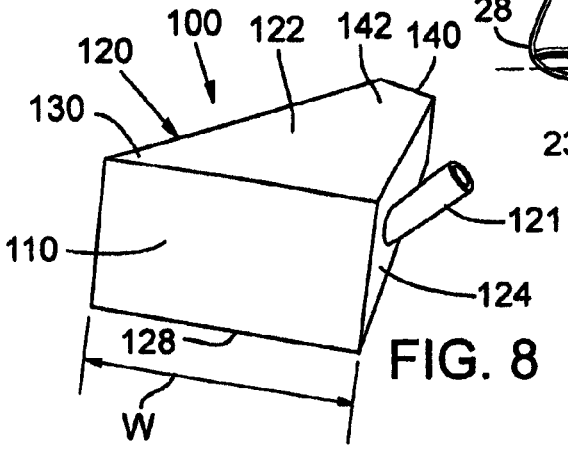
FIG. 8 is a perspective front view of a golf club head according to a second embodiment.
Figure 10:
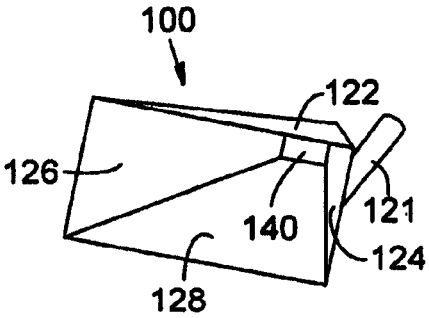
FIG. 10 is a perspective front view of the golf club head of FIG. 8 shown with a face removed.
Figure 9:
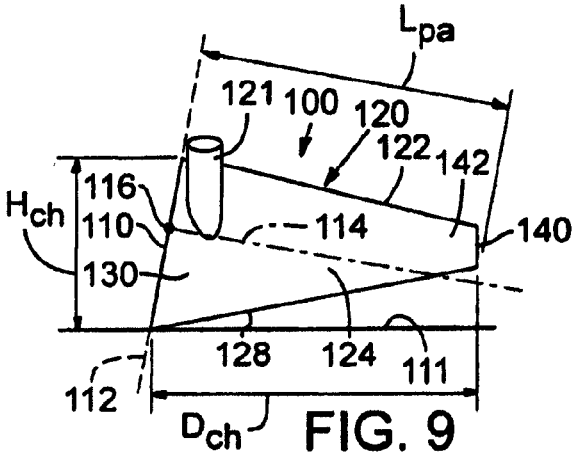
FIG. 9 is an elevational side view of the golf club head of FIG. 8.

One specific exemplary implementation of a golf club head 100 having a generally rectangular ball striking face with a corresponding rectangular ball striking surface 110 is shown in FIGS. 8-10. The golf club head 100 represents an optimal shape of a golf club head having a generally rectangular striking surface and cross-sectional areas for achieving maximum moments of inertia (e.g., $I_{CG_x}$ and $I_{CG_x}$), forgiveness, and playability considering certain constraints, e.g., the current USGA constraints and other considerations including attachment to a club shaft and aesthetics. Golf club head 100 includes a principal axis 114 passing through a geometric center 116 of the ball striking surface 110 and extending normal to the ball striking surface.

The golf club head 100 includes a body 120 having a hosel 121 and four generally planar sides, i.e., top side 122, right side 124, left side 126, and bottom side 128. The sides 122, 124, 126, 128 extend in a tapering manner from the ball striking surface 110 at a forward portion 130 of the golf club head and converging at a generally square end 140 at a rearward portion 142 of the golf club head. Accordingly, the surface area of the ball striking surface 110 is larger than the cross-sectional surface areas of the body 120 along planes parallel to the striking surface.

In the illustrated embodiment, the edges, or intersections, between the sides 122, 124, 126, 128, striking surface 110 and end 140 appear relatively sharp. Of course, any one or more of the sharp edges between the sides, striking surface and end can be eased or radiused without departing from the general relationships. In general, the golf club head 100 has a generally pyramidal, prismatic, pyramidal frustum, or prismatic frustum shape. When viewed from above, or in plan view, the golf club head has a generally triangular or trapezoidal shape.

In one specific implementation, for optimum forgiveness and playability, the ball striking surface 110 has the maximum allowable surface area under current USGA dimensional constraints for golf club heads. In other words, the ball striking surface 110 has a maximum height ($H_{ch}$) of approximately 71 mm (2.8 inches) and a maximum width ($W_{ch}$) of approximately 125 mm (5 inches). Accordingly, the ball striking surface 110 has an area of approximately 8,875 mm$^2$. In other embodiments, the ball striking surface 110 may have a maximum height ($H_{ch}$) between about 67 mm to about 71 mm, a maximum width ($W_{ch}$) between about 118 mm to about 125 mm, and a corresponding ball striking surface area of between about 7,900 $mm^2$ to about 8,875 $mm^2$.

Because the moment of inertia of a golf club head about a CG of the head is proportional to the squared distance of the golf club head mass away from the CG, the golf club head 100 of the specific implementation shown in FIG. 10 has a maximum depth ($D_{ch}$) equal to the maximum allowable depth under current USGA dimensional constraints, i.e., approximately 125 mm. In other embodiments, the golf club head 100 may have a maximum depth ($D_{ch}$) between about 118 mm to about 125 mm. As larger club heads tend to increase the moment of inertia, the golf club head 100 of the specific implementation has a volume equal to the maximum allowable volume under current USGA dimensional constraints, i.e., approximately 460 $cm^3$. The area of the square end 140 may range from about 342 $mm^2$ to about 361 $mm^2$.

The predicted moment of inertia about the CG z-axis $I_{CG_z}$ of golf club head 100 without a loft (not shown), i.e., the ball striking surface 110 or face plane 112 is normal to the ground 111 at address position, and without a hosel is calculated to be 692 kg·$mm^2$. Similarly, the predicted moment of inertia about the CG x-axis $I_{CG_x}$ for a golf club head 100 without a loft and without a hosel is calculated to be 468 kg·$mm^2$. The predicted moment of inertia about the CG z-axis $I_{CG_z}$ of golf club head 100 and with a loft and hosel, as shown in FIG. 9, is calculated to be 615 kg·$mm^2$. Similarly, the predicted moment of inertia about the CG x-axis $I_{CG_x}$ for a golf club head 100 with a loft and hosel is 435 kg·$mm^2$. According to some implementations, solid modeling design software is used to assist in these calculations.

Golf club head 100 may have a CG with an x-axis coordinate between approximately −5 mm and approximately 10 mm, a y-axis coordinate between approximately 20 mm and approximately 50 mm, and a z-axis coordinate between approximately −10 mm and approximately 5 mm. In other embodiments, the CG x-axis coordinate is between approximately −2 mm and approximately 7 mm, the CG y-axis coordinate is between approximately 30 mm and approximately 40 mm, and the CG z-axis coordinate is between approximately −7 mm and approximately 2 mm.

The shape of golf club head 100 can be described according to cross-sectional areas measured at incrementally spaced-apart planes perpendicular to the principal axis 114 along the body. As defined herein, the cross-sectional area of a golf club head at each plane along the principal axis 114 is defined as the area of the plane bounded by the outer surface of the golf club head.

For golf club head 100, a given cross-section area $A_r$ ($mm^2$) corresponds to the following equation:

$$A_r=5512(q/L_{pa})^2-14026(q/L_{pa})+8875 \quad (3)$$

where q is the distance from the striking face plane 112 along the principal axis 114 towards the back of the club head and the principal axis length ($L_{pa}$) is the defined as the distance between the forwardmost and rearwardmost points on the surface of the body 120 measured along the principal axis 114.

According to another embodiment, a golf club head (not shown) can be similar to golf club head 100, but have a generally elliptical ball striking surface and generally elliptical cross-sectional areas. Such a golf club head represents an optimal shape of a golf club head having a generally elliptical ball striking surface and cross-sectional areas for achieving maximum moments of inertia (e.g., $I_{CG_x}$ and $I_{CG_z}$), forgiveness, and playability considering certain constraints, e.g., the current USGA constraints and other considerations including attachment to a club shaft and aesthetics.

According to this embodiment, the golf club head has an elliptical ball striking surface with a minor axis length approximately equal to 71 mm and a major axis length approximately equal to 125 mm. The body of the golf club head extends generally linearly rearward a distance of approximately 125 mm from the striking surface and converges at a rear end of the golf club head. The golf club head has a volume of approximately 460 $cm^3$ and the rear end of the golf club head has a generally circular cross-section with a radius equal to approximately 19 mm.

For the golf club head having a generally elliptical ball striking surface and cross-sectional areas, the predicted moment of inertia about the CG z-axis $I_{CG_z}$ is calculated to be about 650 kg·$mm^2$; and the predicted moment of inertia about the CG x-axis $I_{CG_x}$ is calculated to be about 450 kg·$mm^2$.

In certain embodiments, the golf club head having a generally elliptical ball striking surface and cross-sectional areas may have a CG with an x-axis coordinate between approximately −5 mm and approximately 10 mm, a y-axis coordinate between approximately 20 mm and approximately 50 mm, and a z-axis coordinate between approximately −10 mm and approximately 5 mm. In other embodiments, the CG x-axis coordinate is between approximately −2 mm and approximately 7 mm, the CG y-axis coordinate is between approximately 30 mm and approximately 40 mm, and the CG z-axis coordinate is between approximately −7 mm and approximately 2 mm.

Similar to golf club head 100, this optimal shape of a golf club head having a generally elliptical ball striking surface and cross-sectional areas can be described in terms of the cross-sectional area of the golf club head measured at incrementally spaced-apart planes perpendicular to a principal axis of the club head along the length of the principal axis. The cross-section area $A_e$ ($mm^2$) of a generally elliptical golf club head corresponds to the following equation:

$$A_e=2255(q/L_{pa})^2-8091(q/L_{pa})+6970 \quad (4)$$

where q is the distance from the striking face plane along the principal axis towards the back of the club head and principal axis length ($L_{pa}$) is the defined as the distance between the forwardmost and rearwardmost points on the surface of the golf club head body measured along the principal axis.

Figure 11A:
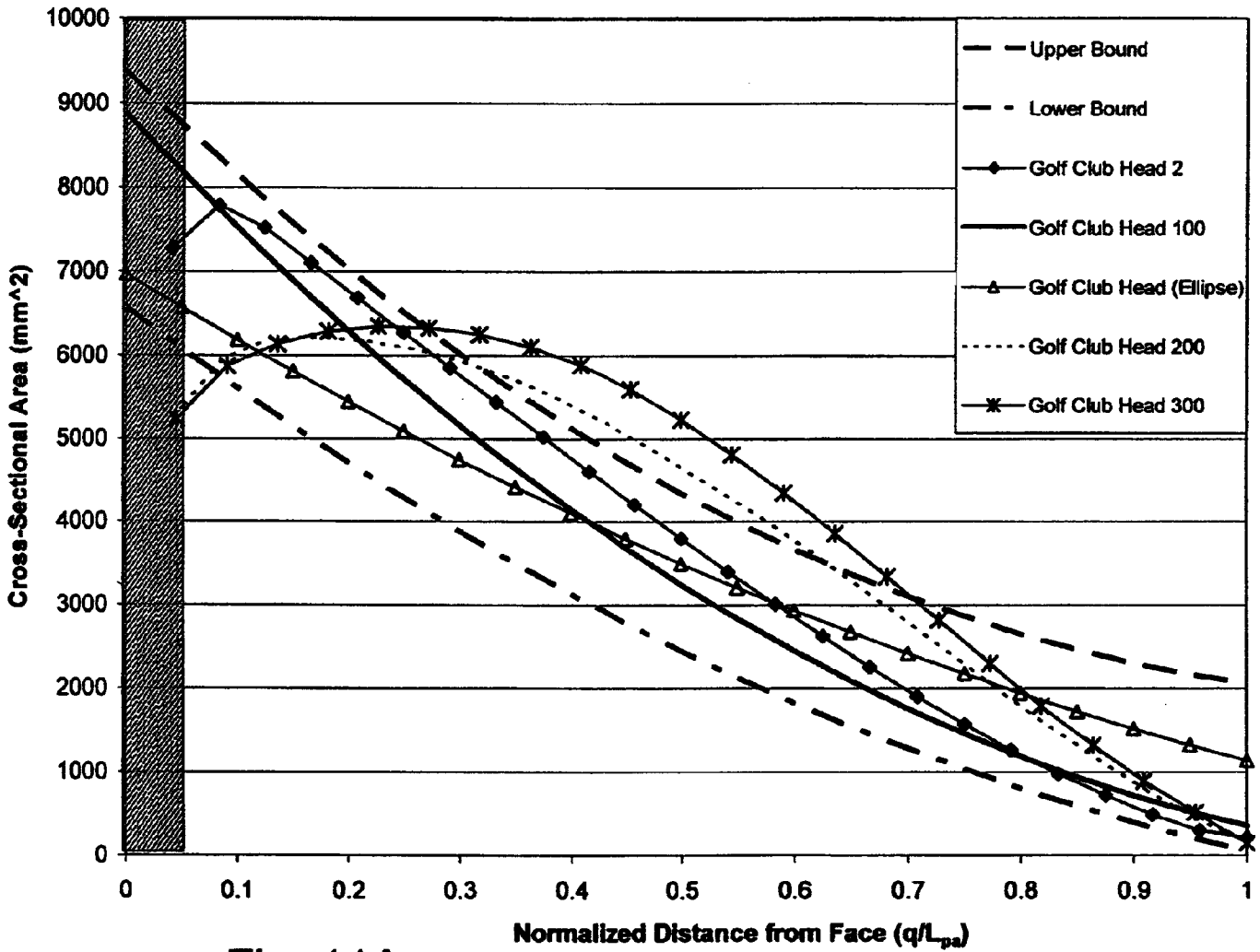
FIG. 11A is a graph illustrating the relationship between the cross-sectional area of various golf club head embodiments of the present application and the normalized distance from a ball striking face of the golf club heads.

The cross-sectional area of golf club head 100 as defined by Equation 3 versus the normalized distance ($q/L_{pa}$) away from the face plane 112 is shown in FIG. 11A. Similarly, the cross-sectional area of the optimal golf club head with the elliptical striking surface and cross-sectional areas as defined by Equation 4 versus the normalized distance ($q/L_{pa}$) away from the face plane of the golf club head also is shown in FIG. 11A.

Embodiments of the optimum shapes of a golf club head having generally rectangular cross-sectional areas and having generally elliptical cross-sectional areas that tend to maximize moments of inertia, forgiveness, and playability have been described above. Of course, these embodiments are merely exemplary and other embodiments of golf club heads having shapes that are similar to, but varying slightly from the optimum shapes, can be used. For example, additional factors, such as hosel shape or placement, internal or external grooves or ribs, exterior appearance, e.g., surface finish, mass properties and distribution, and other physical requirements, can lead to modifications of the optimum head shapes. In addition, golf clubs can be shaped in keeping with the approaches described herein but having cross sections that are not rectangular or elliptical.

Although embodiments of golf club heads with shapes that vary slightly from the optimum shapes may not achieve maximum results as described above, such embodiments still provide higher moments of inertia, and superior levels of forgiveness and playability over conventional golf club heads.

Therefore, according to some embodiments, a golf club head has a shape with cross-sectional areas that fall between a given range along a given portion of the length of the principal axis ($L_{pa}$) of the golf club head. The cross-sectional area range can be defined between an upper cross-sectional area bound $A_u$ ($mm^2$) and a lower cross-sectional area bound $A_l$ ($mm^2$). For example, in one specific embodiment, the upper bound $A_u$ is calculated by the following equation:

$$A_u=A_r+1{,}200(q/L_{pa})+500=5{,}512(q/L_{pa})^2-12{,}826(q/L_{pa})+9{,}375 \quad (5)$$

and the lower bound $A_l$ is calculated by the following equation:

$$A_l=A_r-2{,}000(1-(q/L_{pa}))^2300=5{,}512(q/L_{pa})^2-2{,}000(1-(q/L_{pa}))^2-14{,}026(q/L_{pa})+8{,}575 \quad (6)$$

where q is the distance from the striking face plane along the principal axis towards the back of the golf club head and $L_{pa}$ is the length of the principal axis.

The upper and lower cross-sectional area bounds are shown graphically versus the normalized distance ($q/L_{pa}$) away from a face plane of a golf club head in FIG. 11A. As illustrated in FIG. 11A, the cross-sectional areas of golf club head 100 and the optimum elliptical golf club head are contained within the upper and lower cross-sectional area boundaries $A_u$, $A_l$, respectively, along the entire principal axis length ($L_{pa}$) of the respective golf club heads.

The greater the portion, or percentage, of the golf club head's cross-sectional areas that lie within the optimum cross-sectional area range defined by the upper and lower bounds, the closer the golf club head is to the optimized golf club head shapes as defined above and the more forgiving and playable the golf club head.

Based on this principle, golf club head 2, as described generally above with regards to FIGS. 1-7, is uniquely shaped to closely follow the optimized golf club head shapes while providing an aesthetically pleasing and functional golf club head shape.

Figure 2:
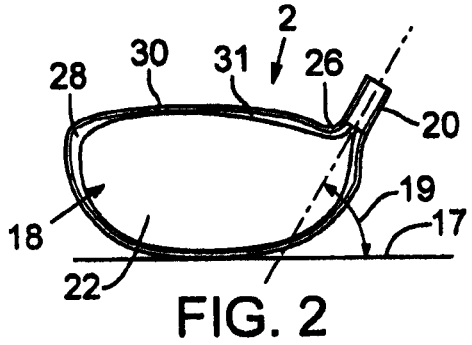
FIG. 2 is an elevational front view of the golf club head of FIG. 1.
Figure 4:
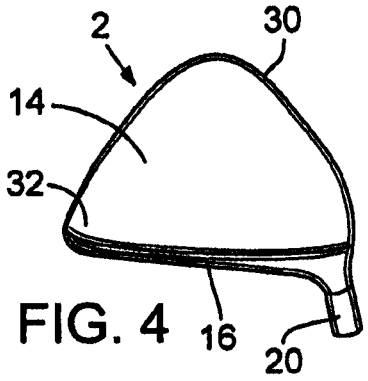
FIG. 4 is a bottom perspective view of the golf club head of FIG. 1.

For example, in the illustrated implementation shown in FIGS. 1-7, the face 18 is sized such that the area of the ball striking surface 22 approaches the maximum allowable surface area under the current USGA rules. Although not necessary, in the illustrated embodiment, the golf club head 2 includes a rounded edge, e.g., transition region, 31 at the intersection between the body 10 and the face 18. With the possible exception of the rounded edge 31, the body 10 tapers, e.g., the portions of the body converge, in a rearwardly direction from the striking surface 22 to the rear portion 32, as best illustrated in FIGS. 2 and 4.

The golf club head body 10 has a generally triangular-shaped or frusto-triangular-shaped, outer periphery 34 when viewed from above, or in plan view, as shown in FIG. 3. The outer periphery 34 includes a front edge 33, first side edge 35, and second side edge 37. Accordingly, the golf club head 10 can be described as having a 3-sided shape in plan. The front edge 33 extends along the crown 12 from the heel portion 26 to the toe portion 28 proximate the front portion 30 of the body 10, e.g., along the intersection between the striking surface 22 and the body 10. The first edge 35 extends from the heel portion 26 to the rear portion 32 and the second edge 37 extends from the toe portion 28 to the rear portion.

In the illustrated embodiment, the front edge 33, first side edge 35, and second side edge 37 are linear. As used herein, linear means straight or slightly curved, i.e., having a radius of curvature of at least approximately 150 mm. In one specific implementation, the radius of curvature of the front edge 33 is approximately 600 mm, the radius of curvature of the first side edge 35 is approximately 350 mm, and the radius of curvature of the second side edge 37 is approximately 400 mm. The front edge 33 extends generally parallel to the face plane 27 of the head 2 and the first and second edges 35, 37 extend at first and second angles 41, 43, respectively, relative to the front edge 33 and face plane. Further, a third angle 45 is defined between the first edge and principal axis 40 and a fourth angle 47 is defined between the second edge and the principal axis. In some implementations, the first angle 41 is between approximately 50° and approximately 70°, the second angle 43 is between approximately 50° and approximately 70°, and the third and fourth angles 45, 47 are between approximately 20° and approximately 60°. In other embodiments, one or more of the edges is straight.

In the illustrated embodiment, the first and second edges 35, 37 have an approximately equal length and the first and second angles are approximately equal to each other such that the outer periphery 34 of the golf club head 2 in plan defines a generally isosceles triangle. In other embodiments, the first and second edges 35, 37 can have different lengths.

As shown in FIG. 3, the golf club head 2 can include rounded edges, e.g., transition regions 39, at the intersections between the front, first, and second edges 33, 35, 37. The transition regions 39 can be radiused and have a radius substantially less than the radiuses of the front, first, and second side edges 33, 35, 37. Accordingly, the outer periphery of the golf club head when viewed from above can be a generally frusto-triangular shape, i.e., a generally triangular shape having cut-off or rounded corners.

In some implementations, the first and second edges 35, 37 extend rearwardly from a normalized distance ($q/L_{pa}$) along the principal axis 40 of approximately 0.05 away from the face plane 27 to a normalized distance of approximately 0.95 away from the face plane. In specific exemplary implementations, such as shown in FIG. 3, the first and second edges 35, 37 extend rearwardly from a normalized distance of approximately 0.10 away from the face plane 27 to a normalized distance of approximately 0.90 away from the face plane. According to one specific exemplary implementation, golf club head 2 has a height, width, depth, and volume at or near, such as within 95% of one or more of the maximum allowable height, width, depth and volume under the current USGA constraints. The cross-sectional area of this specific implementation of golf club head 2 versus the normalized distance ($q/L_pa$) along the principal axis away from the face plane 27 is shown in FIG. 11A.

As shown, the cross-sectional area of golf club head 2 is also contained within the upper and lower cross-sectional area boundaries $A_u$, $A_l$, respectively, along the entire depth of the golf club head 2, i.e., 100% of the golf club head depth.

In certain exemplary embodiments, the golf club head 2 is made of titanium and has a mass between approximately 200 grams and approximately 210 grams. In one specific embodiment, the head 2 has a mass of approximately 203 grams. In certain exemplary embodiments, the moment of inertia about the CG x-axis 70 is between approximately 370 kg·$mm^2$ and approximately 390 kg·$mm^2$. In one specific embodiment, the moment of inertia about the CG x-axis 70 is approximately 380 kg·$mm^2$. In certain exemplary embodiments, the moment of inertia about the CG z-axis 85 is between approximately 525 kg·mm$^2$ and approximately 545 kg·mm$^2$. In one specific embodiment, the moment of inertia about the CG z-axis 85 is approximately 535 kg·mm$^2$.

In certain exemplary embodiments, the golf club 2 has a CG x-axis coordinate between approximately 4 mm and approximately 6 mm. In one specific embodiment, the CG x-axis coordinate is approximately 5 mm. In certain exemplary embodiments, the golf club 2 has a CG y-axis coordinate between approximately 31 mm and approximately 35 mm. In one specific embodiment, the CG y-axis coordinate is approximately 33 mm. In certain exemplary embodiments, the golf club 2 has a CG z-axis coordinate between approximately −2 mm and approximately −4 mm. In one specific embodiment, the CG z-axis coordinate is approximately −3 mm.

Referring to FIGS. 12-15, and according to another exemplary embodiment, a golf club head shaped to provide increased moments of inertia and greater forgiveness than conventional golf club head shapes is shown.

Similar to golf club head 2, golf club head 200 has a hollow body 202 with a crown 250, a sole 252, a skirt 254, a striking face 256, and a hosel 258. The body 202 further includes a heel portion 260, a toe portion 262, a front portion 264, and a rear portion 266. The striking face 256 includes an outwardly facing ball striking surface 259 that defines a face plane 240 described as the plane tangent to an ideal impact location on the striking surface, i.e., a geometric center 268 of the striking surface.

Figure 15:
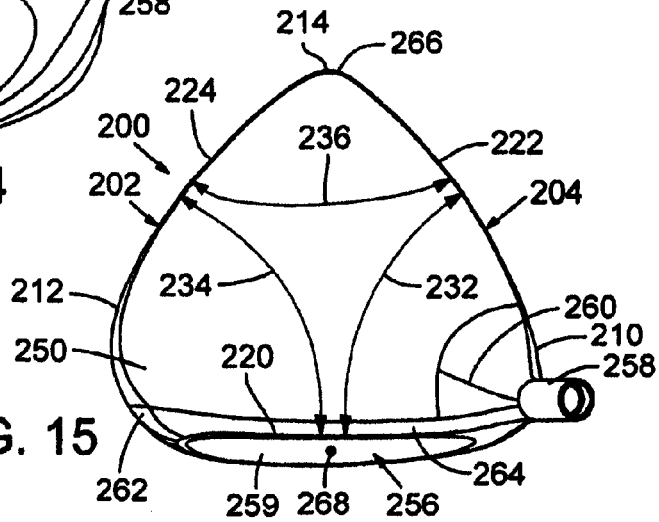
FIG. 15 is a top view of the golf club head of FIG. 12.
Figure 16:
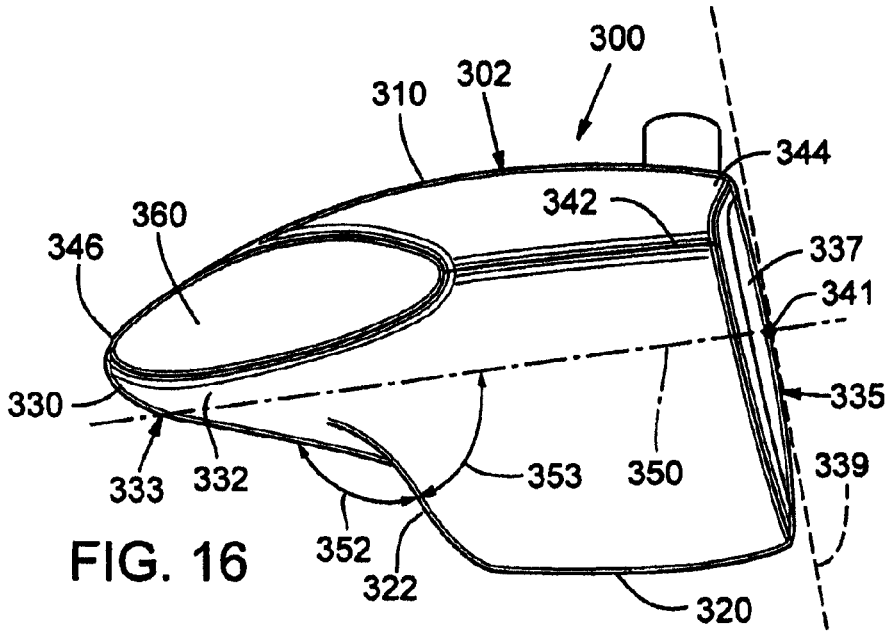
FIG. 16 is an elevational side view of a golf club head according to a fourth embodiment.
Figure 17:
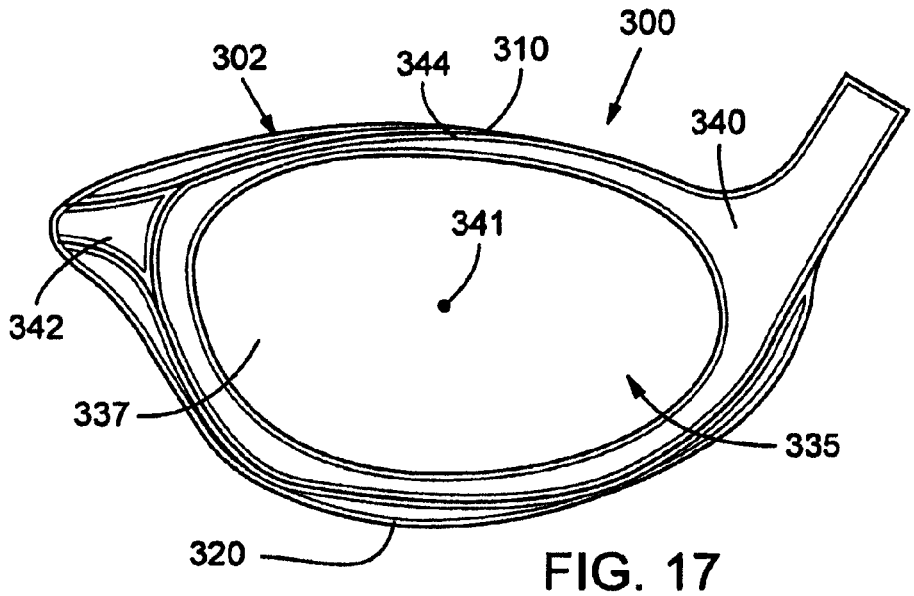
FIG. 17 is an elevational front view of the golf club head of FIG. 16.

The body 202 has a generally triangular-shaped, or frusto-triangular-shaped, outer periphery 204 when viewed from above as shown in FIG. 15. However, the transition region 210 between front edge 220 and first edge 222, and the transition region 212 between the front edge and second edge 224 each have radiuses that are larger than the radiuses of transition regions 39 of golf club head 2. In other words, the transition regions 210, 212 of the outer periphery 204 of golf club head 200 are more rounded than the transition regions 39 of the outer periphery 34 of golf club head 2.

Golf club head 200 includes a transition region 214 at the intersection of first and second edges 222, 224. Transition region 214 can be radiused relative to the first and second edges 224, 224 in a manner similar to that described above in relation to transition regions 29 of golf club head 2.

Like golf club head 2, the first and second edges 222, 224 are substantially linear as defined above and extend rearwardly from the transition regions 210, 212, respectively, to the transition region 214 at a rear portion 266 of the golf club head 200. The first and second edges 222, 224 extend in a forward to rearward direction at angles 232, 234, respectively, relative to the front edge 220 and an angle 236 relative to each other. In some implementations, angle 232 is between approximately 50° and approximately 70°, angle 234 is between approximately 45° and approximately 65°, and angle 236 is between approximately 60° and approximately 80°.

According to one specific exemplary implementation, golf club head 200 has a height, width, depth, and volume as defined above, i.e., at, or near the maximum allowable height, width, depth, and volume under the current USGA constraints. The cross-sectional area of this specific implementation of golf club head 200 versus the normalized distance ($q/L_{pa}$) along a principal axis away from the face plane 240 of the head is shown in FIG. 11A. As shown, the cross-sectional area of golf club head 200 is contained within the upper and lower cross-sectional area boundaries $A_u$, $A_l$, respectively, along approximately 64% of the depth of the golf club head 200.

In certain exemplary embodiments, the golf club head 200 is made of titanium and has a mass between approximately 200 grams and approximately 210 grams. In one specific embodiment, the head 200 has a mass of approximately 203 grams. In certain exemplary embodiments, the moment of inertia about the CG x-axis is between approximately 310 kg·mm$^2$ and approximately 340 kg·mm$^2$. In one specific embodiment, the moment of inertia about the CG x-axis is approximately 330 kg·mm$^2$. In certain exemplary embodiments, the moment of inertia about the CG z-axis is between approximately 495 kg·mm$^2$ and approximately 515 kg·mm$^2$. In one specific embodiment, the moment of inertia about the CG z-axis is approximately 503 kg·mm$^2$.

In certain exemplary embodiments, the golf club 200 has a CG x-axis coordinate between approximately 4 mm and approximately 6 mm. In one specific embodiment, the CG x-axis coordinate is approximately 5 mm. In certain exemplary embodiments, the golf club 200 has a CG y-axis coordinate between approximately 34 mm and approximately 38 mm. In one specific embodiment, the CG y-axis coordinate is approximately 36 mm. In certain exemplary embodiments, the golf club 200 has a CG z-axis coordinate between approximately −2 mm and approximately −4 mm. In one specific embodiment, the CG z-axis coordinate is approximately −3 mm.

Referring to FIGS. 16-19, and according to another exemplary embodiment, a golf club head, e.g., golf club head 300, shaped to provide increased moments of inertia and greater forgiveness than conventional golf club head shapes is shown.

Golf club head 300 includes a hollow body 302 having a crown 310, a sole 320, a skirt 330, and a striking face 335. The body 302 also includes a heel portion 340, a toe portion 342, a front portion 344, and a rear portion 346. The club head 300 has a height, width, and depth as defined above in relation to golf club head 2. The striking face 335 includes an outwardly facing ball striking surface 337 that defines a face plane 339 described as the plane tangent to an ideal impact location on the striking surface, i.e., a geometric center 341 of the striking surface.

A substantial portion of sole 320, such as approximately 90%, extends rearwardly from the lowest point of the front portion 344 of the golf club head 300 proximate the striking face 335 and generally parallel to the principal axis 350 of the golf club head. The remaining portion of the sole 320, i.e., the rearward facing portion 322, extends rearwardly and substantially upwardly at an angle 353 relative to the principal axis 350 until it transitions into an overhanging rear portion 333, or rim. The overhanging rear portion 333 extends about a rearward portion of the crown 310 and skirt 16. In certain implementations, the angle 353 is between approximately 45° and approximately 75°.

The lower edge 332 of the skirt 330 rearward of the sole 320 protrudes rearwardly from the rearward facing portion 322 of the sole 320 at an angle 352 to define an indentation or concave portion. In specific implementations, the angle 352 is between approximately 100° and approximately 170°. In the illustrated embodiment, the lower edge 332 extends at the same general angle 322 until it transitions into the crown 310 proximate the rear portion 346 of the golf club head 300.

The golf club head 300 also includes toe and heel side walls 360, 370, respectively. The toe and heel side walls 360, 370 include approximately planar surfaces that extend along the crown 310 and skirt 330 of the golf club head 300. The side walls 360, 370 define respective planes that, in some implementations, extend normal to the ground when the head 300 is in proper address position. In other implementations, the respective side wall planes can extend at any of various angles less than or greater than 90° relative to the ground. The toe side wall 360 extends at an angle 362 relative to principal axis 350 and the heel side wall 370 extends at an angle 372 relative to the principal axis. In some applications, the angles 362, 372 are each between approximately 20° and approximately 60°. In some implementations, the angles 362, 372 are the same and in other implementations, the angles are different.

According to the USGA regulations, abrupt indentations or concave portions of a golf club head are filled in for purposes of determining volumetric displacement of a golf club head. For example, the space defined between the rearward facing portion 322, the overhanging rear portion 333, and an imaginary surface gradually transitioning from the sole 320 to the skirt 330 over the indentation, would be included in the determination of the volumetric displacement of golf club head 300. Therefore, in some implementations, in order to remain within the USGA volumetric constraints while still providing improved forgiveness and playability, the volume of the golf club head can be reduced by forming substantially straight, planar side walls, such as toe and heel side walls 360, 370, in contrast to the curved sidewalls of conventional club heads.

Figure 18:
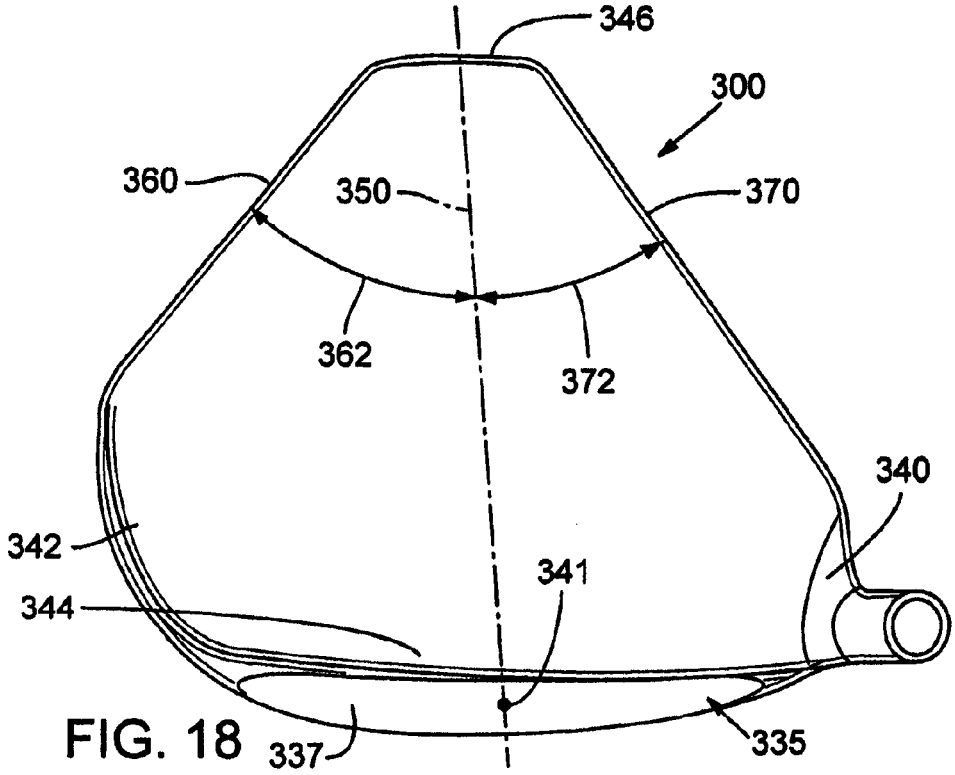
FIG. 18 is a top view of the golf club head of FIG. 16.
Figure 19:
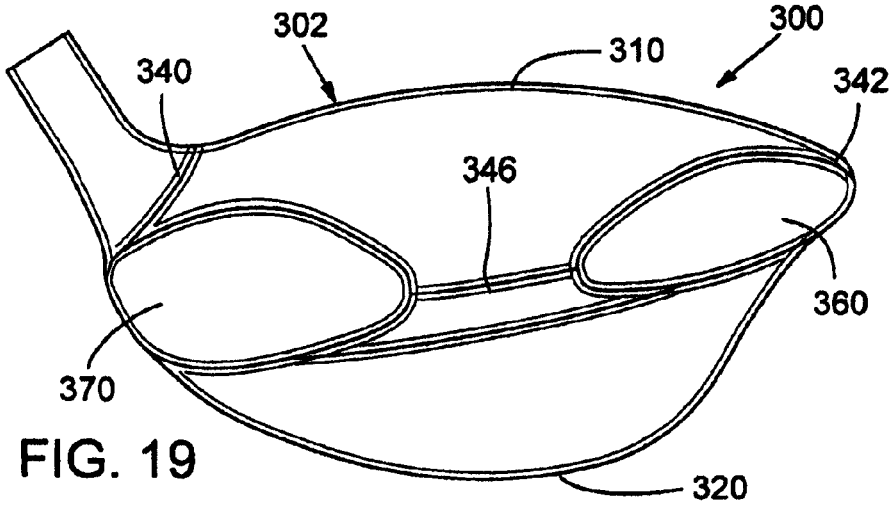
FIG. 19 is an elevational rear view of the golf club head of FIG. 16.

Referring to FIG. 18, the toe and heel side walls 360, 370 each extend a substantial portion of the depth of the golf club head 300. In certain implementations, the side walls 360, 370 extend forwardly from the rear portion 346 at least approximately 40% of the depth of the golf club head 300. In specific implementations, such as shown, the toe side wall 360 extends approximately 50% of the golf club head depth and heel side wall 370 extends approximately 75% of the golf club head depth. As with golf club heads 2, 100, 200, golf club head 300 includes a generally triangular-shaped or frusto-triangular-shaped outer periphery 204 when viewed from above.

Generally, golf club head 300 is shaped to approach the maximum dimensional and volumetric constraints issued by the USGA while providing a golf club head having a more traditional look and feel from a golfer's perspective, i.e., from above, at the proper address position. This is at least partially accomplished by the unique configuration of the sole 320 and skirt 330, and the inclusion of generally vertical side walls 360, 370.

The cross-sectional area of golf club head 300 according to the illustrated embodiment versus the normalized distance ($q/L_{pa}$) along the principal axis 350 away from the face plane 339 of the head as defined above is shown in FIG. 11A. As shown, the cross-sectional area of golf club head 200 is contained within the upper and lower cross-sectional area boundaries $A_u$, $A_l$, respectively, along approximately 52% of the depth of the golf club head 300.

In certain exemplary embodiments, the golf club head 300 is made of titanium and graphite epoxy composite and has a mass between approximately 200 grams and approximately 210 grams. In one specific embodiment, the head 300 has a mass of approximately 203 grams. In certain exemplary embodiments, the moment of inertia about the CG x-axis is between approximately 350 kg·mm$^2$ and approximately 550 kg·mm$^2$. In one specific embodiment, the moment of inertia about the CG x-axis is approximately 450 kg·mm$^2$. In certain exemplary embodiments, the moment of inertia about the CG z-axis is between approximately 450 kg·mm$^2$ and approximately 600 kg·mm$^2$. In one specific embodiment, the moment of inertia about the CG z-axis is approximately 540 kg·mm$^2$.

In certain exemplary embodiments, the golf club 300 has a CG x-axis coordinate between approximately 0 mm and approximately 6 mm. In one specific embodiment, the CG x-axis coordinate is approximately 3 mm. In certain exemplary embodiments, the golf club 300 has a CG y-axis coordinate between approximately 35 mm and approximately 41 mm. In one specific embodiment, the CG y-axis coordinate is approximately 38 mm. In certain exemplary embodiments, the golf club 300 has a CG z-axis coordinate between approximately 0 mm and approximately −6 mm. In one specific embodiment, the CG z-axis coordinate is approximately −3 mm.

Figure 11B:
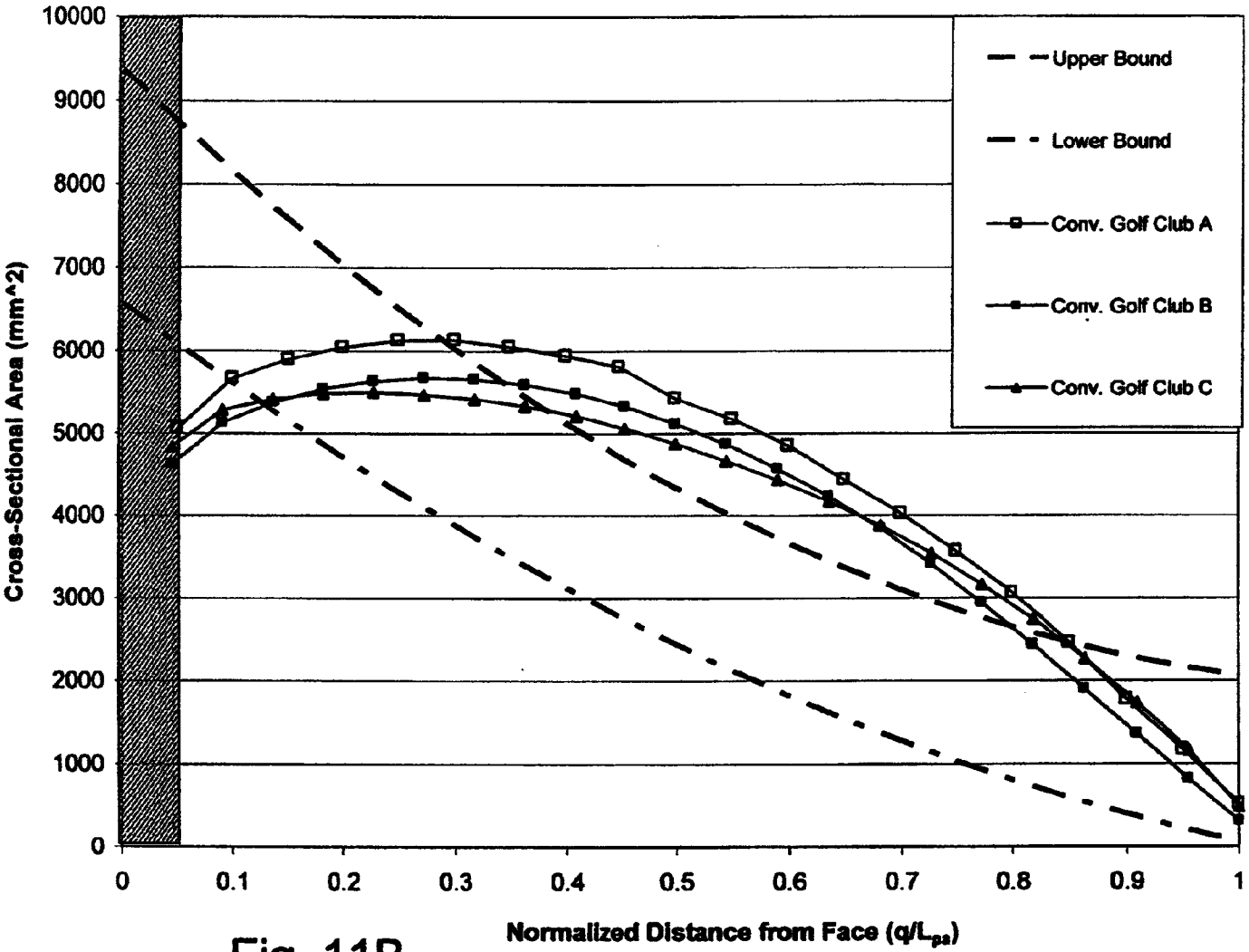
FIG. 11B is a graph illustrating the relationship between the cross-sectional area of various conventional golf club heads and the normalized distance from a ball striking face of the conventional golf club heads.
Figure 12:
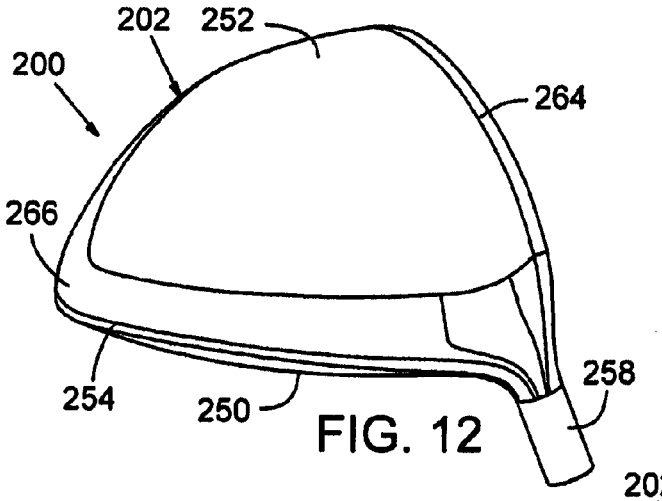
FIG. 12 is a bottom perspective view of a golf club head according to a third embodiment.
Figure 13:
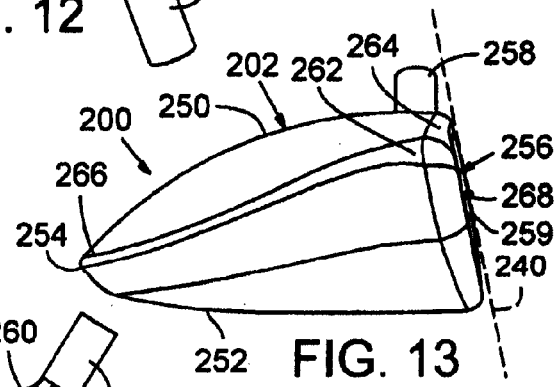
FIG. 13 is an elevational side view of the golf club head of FIG. 12.
Figure 14:
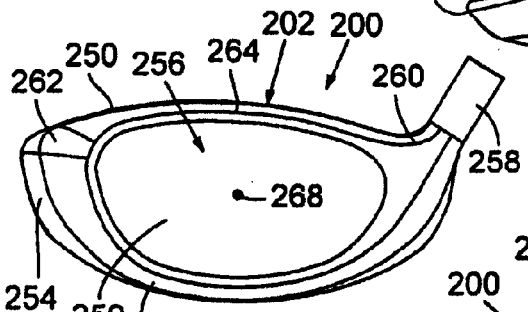
FIG. 14 is an elevational front view of the golf club head of FIG. 12.

For comparison, cross-sectional areas of various publicly available conventional golf club heads are shown in FIG. 11B. For example, conventional golf club head A has cross-sectional areas within the upper and lower cross-sectional area bounds $A_u$, $A_l$ along approximately 32% of the golf club head depth. Conventional golf club head B has cross-sectional areas within the upper and lower cross-sectional area bounds $A_u$, $A_l$ along only approximately 32% of the golf club head depth. Also, conventional golf club head C, which has a generally square shape in plan, has cross-sectional areas within the upper and lower cross-sectional area bounds $A_u$, $A_l$ along only approximately 38% of the golf club head depth.

Based on the foregoing results, and in contrast to conventional golf club heads, such as those represented in FIG. 11B, the golf club head embodiments of the present disclosure each have cross-sectional areas that fall within the upper and lower cross-sectional bounds $A_u$, $A_l$, respectively, along at least approximately 50% of the depth of the respective heads.

For the sake of determining the cross-sectional area of conventional golf club heads having external hosels, the portion of the hosel having a constant diameter is not considered to be part of the cross-sectional area. In other words, the portion of the hosel extending from the crown up to the transition between the diverging portion of the hosel and the constant diameter portion of the hosel is included in the calculation of the cross-sectional area. Further, the portion of the golf club head between $q/L_{pa}=0$ and $q/L_{pa}=0.05$ was not included in the calculation of the cross-sectional area percentages discussed above because of the cross-sectional area fluctuations associated with the bulge and roll of the striking face surfaces of typical golf club heads.

In view of the many possible embodiments to which the principals of the disclosed golf club head may be applied, it should be recognized that the illustrated embodiments are only preferred examples and should not be taken as limiting the scope of the disclosed golf club head. Rather, the scope of the invention is defined by the following claims. We therefore claim as our invention all that comes within the scope and spirit of these claims.

We claim:

1. A golf club head comprising:

a body defining an interior cavity and comprising a sole positioned at a bottom portion of the golf club head, a crown positioned at a top portion, and a skirt positioned around a periphery between the sole and the crown, wherein at least a portion of the sole, a portion of the crown and a portion of the skirt are formed of a same material, wherein the body has a forward portion and a rearward portion; and a face positioned at the forward portion of the body, the face having an ideal impact location, wherein a face plane is defined to extend tangential to the ideal impact location;

wherein the body extends a distance L transversely away from the face plane and defines cross-sectional areas A along planes parallel to the face plane and spaced rearward from the face plane by a distance q, wherein a body region is defined between a dimension of q/L of about 0.05 to a dimension of q/L of about 1.0, and wherein within the body region at least about 50% of the cross-sectional areas A are between an upper cross-sectional area limit $A_u$ and a lower cross-sectional area limit $A_1$, where (1) $A_u=5512(q/L)^2-14026(q/L)+8875+1200(q/L)+500$, and (2) $A_1=5512(q/L)^2-14026(q/L)+8875-2000[1-(q/l)]^2-300$;

wherein the golf club head has a head origin defined as a position on the face plane at a geometric center of the face, the head origin including an x-axis tangential to the face and generally parallel to the ground when the head is ideally positioned where a positive x-axis extends towards the heel portion, a y-axis extending perpendicular to the x-axis and generally parallel to the ground when the head is ideally positioned where a positive y-axis extends from the face and through the rearward portion of the body, and a z-axis extending perpendicular to the ground, to the x-axis and to the y-axis when the head is ideally positioned where a positive z-axis extends from the origin and generally upward, wherein the golf club head has a center of gravity with an x-axis coordinate between approximately −5 mm and approximately 10 mm, a y-axis coordinate between approximately 20 mm and approximately 50 mm, and a z-axis coordinate between approximately −10 mm and approximately 5 mm.

2. The golf club head of claim 1, wherein at least about 60% of the cross-sectional areas A within the body region are between the upper cross-sectional area limit $A_u$ and the lower cross-sectional area limit $A_1$.

3. The golf club head of claim 1, wherein at least about 70% of the cross-sectional areas A within the body region are between the upper cross-sectional area limit $A_u$ and the lower cross-sectional area limit $A_1$.

4. The golf club head of claim 1, wherein at least about 80% of the cross-sectional areas A within the body region are between the upper cross-sectional area limit $A_u$ and the lower cross-sectional area limit $A_1$.

5. The golf club head of claim 1, wherein the golf club head has a moment of inertia about a head center of gravity x-axis of at least approximately 300 kg·mm$^2$ and a moment of inertia about a head center of gravity z-axis of at least approximately 450 kg·mm$^2$.

6. The golf club head of claim 1, wherein the golf club head has a volume between approximately 350 cm$^3$ and approximately 500 cm$^3$.

7. The golf club head of claim 1, wherein the distance L is between approximately 100 mm and approximately 170 mm.

8. The golf club head of claim 1, wherein the golf club head has a width between approximately 100 mm and approximately 170 mm.

9. The golf club head of claim 1, wherein the face comprises a face plate made from a composite material.

10. The golf club head of claim 1, wherein the golf club head has a center of gravity with an x-axis coordinate between approximately −2 mm and approximately 7 mm, a y-axis coordinate between approximately 30 mm and approximately 40 mm, and a z-axis coordinate between approximately −7 mm and approximately 2 mm.

11. A golf club head comprising:

a body defining an interior cavity and comprising a sole that forms a bottom portion of the golf club head, a crown that forms a top portion of the golf club head, and a skirt that forms a periphery of the golf club head from a toe portion to a heel portion and between the sole and the crown, wherein at least a portion of the sole, a portion of the crown, and a portion of the skirt are formed of a same material, wherein the body has a forward portion and a rearward portion; and a face positioned at the forward portion of the body and having (i) a ball striking surface area and (ii) an ideal impact location, wherein a face plane is defined to extend tangential to the ideal impact location; and wherein the body extends a distance L transversely away from the face plane and comprises a first outermost peripheral edge extending from the heel portion to the rearward portion and a second outermost peripheral edge extending from the toe portion to the rearward portion, and wherein the first outermost peripheral edge forms an angle with the second outermost peripheral edge between approximately 45° and approximately 75° within a body region defined approximately between q/L of about 0.10 and q/L of about 0.9 where q is a distance away from the face plane in a direction generally perpendicular to the face plane.

12. The golf club head of claim 11, wherein the distance L is between approximately 100 mm and approximately 170 mm.

13. The golf club head of claim 11, wherein the golf club head has a width between approximately 100 mm and approximately 170 mm.

14. The golf club head of claim 11, wherein the golf club head has a height between approximately 60 mm and approximately 85 mm.

15. The golf club head of claim 11, wherein the first and second peripheral edges within the body region are substantially linear.

16. The golf club head of claim 11, wherein the periphery of the golf club head when viewed from above defines a generally triangular shape.

17. The golf club head of claim 11, wherein the golf club head has a head origin positioned on the face plane at the geometric center of the face, the head origin including an x-axis tangential to the face and generally parallel to the ground when the head is ideally positioned where a positive x-axis extends towards the heel portion, a y-axis generally perpendicular to the x-axis and generally parallel to the ground when the head is ideally positioned where a positive y-axis extends towards the interior cavity, and a z-axis generally perpendicular to the ground and the x-axis and y-axis when the head is ideally positioned where a positive z-axis extends towards the top portion, wherein the golf club head has a center of gravity with an x-axis coordinate between approximately −2 mm and approximately 7 mm, a y-axis coordinate between approximately 30 mm and approximately 40 mm, and a z-axis coordinate between approximately −7 mm and approximately 2 mm.

18. The golf club head of claim 11, wherein the golf club head has a volume between about 350 cm$^3$ and about 500 cm$^3$ and a center of gravity within the body.

19. A high forgiveness wood-type golf club head comprising:

a body defining an interior cavity and comprising a sole positioned at a bottom portion of the golf club head, a crown positioned at a top portion of the golf club head, a skirt positioned around a periphery of the golf club head between the sole and the crown, wherein at least a portion of the sole, a portion of the crown, and a portion of the skirt are formed of a same material, wherein the body defines an outer periphery having a generally triangular shape in plan; and a face positioned at a front portion of the golf club head opposite a rear portion of the golf club head, wherein the face defines an ideal impact location and a face plane is defined to extend tangential to the ideal impact location, and wherein the body has a principal axis extending normal to the face, and the body extends an overall distance L along the principal axis and angle of sides relative to axis, and wherein the body defines a first side edge in plan and a second side edge in plan, the second side edge forming an angle between approximately 20° and approximately 60° with the principal axis within an intermediate body region defined approximately between q/L =0.20 and q/L =0.8, where q is a distance away from the face plane along the principal axis.

20. The golf club head of claim 19, wherein the body comprises an overhanging rear portion.

* * * * *